US005902952A

United States Patent [19]

DelGuidice et al.

[11] Patent Number: 5,902,952

[45] Date of Patent: May 11, 1999

[54] ANTI TIP-OFF DEVICE

[75] Inventors: Thomas A. DelGuidice, King George; Fred W. Watson, Jr., Montross, both of Va.

[73] Assignee: The United States of America as represented by the Secretary of the Navy, Washington, D.C.

[21] Appl. No.: 08/941,930

[22] Filed: Sep. 30, 1997

[51] Int. Cl.[6] ..... F41F 5/00; F41F 3/04

[52] U.S. Cl. ..... 89/1.819; 89/1.8

[58] Field of Search ..... 89/1.819, 1.816, 89/1.817, 1.81, 1.809, 1.8; 102/520, 521; 244/3.24, 3.25, 3.26, 3.27, 3.28, 3.29

[56] References Cited

U.S. PATENT DOCUMENTS

| | | | |
|---|---|---|---|
| H403 | 1/1988 | Glasser | 102/520 |
| H405 | 1/1988 | Covey | 89/1.816 |
| 211,778 | 1/1879 | Pierce | 244/3.28 |
| 3,038,382 | 6/1962 | Noyes et al. | 89/1.7 |
| 3,267,809 | 8/1966 | Sikora | 89/1.819 |
| 3,857,320 | 12/1974 | Conard | 89/1.816 |
| 3,946,639 | 3/1976 | Sanvito et al. | 89/1.816 |
| 4,227,438 | 10/1980 | Precoul | 89/1.816 |
| 4,314,510 | 2/1982 | Jeter et al. | 102/521 |
| 4,327,624 | 5/1982 | Piesik | 89/1.816 |
| 4,430,942 | 2/1984 | Heyman | 102/530 |
| 4,616,554 | 10/1986 | Spink et al. | 89/1.816 |
| 4,756,226 | 7/1988 | Piesik | 89/1.816 |
| 5,323,708 | 6/1994 | Sigler | 102/520 |
| 5,398,588 | 3/1995 | Peck | 89/1.816 |
| 5,479,861 | 1/1996 | Kinchin | 102/520 |
| 5,515,787 | 5/1996 | Middleton | 102/521 |

*Primary Examiner*—Charles T. Jordan
*Assistant Examiner*—Theresa M. Wesson
*Attorney, Agent, or Firm*—James B. Bechtel, Esq.

[57] ABSTRACT

An anti tip-off device for rocket rockets adapted for collapsible tube-in-tube launchers is provided. The dual-diameter launch tube requires stabilization of the rocket within the larger diameter tube. The anti tip-off device has two segments which together form a hollow cylinder which fits over the nose section of a standard high explosive anti-armor rocket. A sliding surface is located around the circumference of the cylinder to provide support for the rocket during transit of the larger launch tube. The surface contact prevents the rocket from wobbling or tipping during the rocket's transit of the launch tube. Alternately, permanently-bonded stabilizer legs or a bonded ring may be attached to the rocket to match the diameter of the larger launch tube. The anti tip-off device may be fabricated using any material suited to the launcher and rocket combination, including lexan, teflon, nylon, wood, or aluminum.

3 Claims, 7 Drawing Sheets

ANTI TIP-OFF DEVICE

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to the rocket and projectiles field and in particular to the use of stabilizers during rocket or projectile firing.

BACKGROUND OF THE INVENTION

The current Shoulder-Launched Multipurpose Assault Weapon (SMAW) represents a breakthrough in rocket launchers. The latest version of the SMAW manifests a wide variety of improvements designed with improving the operability of the weapon by a single person. Decreases in weapon weight, the movement of the spotting rifle from a side mounted to a bottom-mounted design, and improvements in the sighting and targeting mechanisms have been disclosed in earlier applications. Alone, these improvements have effectively reduced the need for a second person to assist the weapon's primary operator during weapon aiming and firing. However, the methods used in the prior art for attachment of the rocket still represent problems for the efficient use of the new SMAW weapon.

In the prior art, the rocket is enclosed within a separate canister which is connected to the launcher at the time of firing. When the rocket canister is attached, the weapon is at full length, and, due to the bulkiness and length of the barrel, is not maneuverable. One particular problem is that the size of the weapon prevents its easy transport by personnel moving from site to site. In order to move quickly, the weapon must be disassembled and transported in an unloaded fashion. In addition to time lost to unload and reload the rocket, a further disadvantage to this system occurs when hostile forces are encountered during movement. The rocket launcher is not ready for firing. Crucial time must be spent re-connecting the rocket pack to the launcher; time during which the launcher operator is vulnerable to assault by the hostile forces.

In order to remedy these problems, the new SMAW weapon uses a tube within a tube design. This design provides that the launch tube is made up in two sections of a smaller diameter firing tube and a larger diameter rocket tube. The rocket can be attached to the firing tube, and then simply slid into the firing tube for transport. When the need to fire arises, the rocket tube is slid back out from the firing tube and locked in position in a matter of seconds. The use of the tube within a tube design, however, introduces an important obstacle. The diameter of the two tubes must be different. Specifically, the diameter of the rocket tube is correctly sized to the rocket, but the diameter of the firing tube is much larger. During launch, the rocket has not yet gained sufficient velocity to allow for the rocket to stabilize itself by the time the wider tube is entered. The forward end of the rocket is able to tip down or wobble within the rocket tube. This wobble causes several problem effects, including a dramatic reduction in accuracy, possible tumbling of the rocket, and early impact and detonation of the rocket. These effects reduce the combat effectiveness of the weapon and create a safety hazard for the launcher operator.

Prior efforts have been made to provide stabilizers for substantially smaller rockets within a single weapons system. These attempts have been directed towards the use of multiple different caliber weapons within a single tube of constant diameter. A means for stabilizing a rocket in launch tube with multiple bore diameters is needed.

SUMMARY OF THE INVENTION

It is an object of this invention to provide a means for centering a rocket within a launch tube having two distinct bore diameters.

It is another object of the invention to provide an anti tip-off device which can be attached to rockets of varying diameter without requiring adjustment or modification of the stabilizer.

It is yet another object of the invention to provide an anti tip-off device which can be attached to a rocket without requiring modification of the rocket.

A still further object of the present invention is to provide anti tip-off devices of sufficient strength to hold the rocket in the proper orientation during launch without impeding the launch characteristics of the rocket through either heavy weight or substantial launch function.

Accordingly, the invention is an anti tip-off device for dual diameter launch tubes which attaches to the front end of the rocket canister. The function of the anti tip-off device is to center and stabilize the rocket in the larger diameter forward launcher tube section. In one embodiment, the anti tip-off device comprises two segments which together form a cylinder around the extended nose of an anti-armor rocket. The center sections of the segments are cut out so that the segments may fit concentrically around the rocket nose. Located around the circumference of the cylinder formed by the segments is a bearing surface which contacts the larger diameter rocket tube. The segments separate after the rocket leaves the muzzle of the launcher allowing rocket flight with the segments removed. Alternately, three or more stabilizer legs may be bonded permanently on the forward portion of the rocket or a stabilizer ring may be attached to the forward portion of the rocket. The rocket's movement through the tube locks the ring-style anti tip-off device in place. The anti tip-off devices provide precision centering of the rocket along the axis of the launch tube until the rocket clears the tube and achieves flight stability.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Tip-off, or non-alignment with the launch tube, immediately after a projectile leaves a launcher barrel is a problem with all ballistic systems. This problem is worsened with shorter barrels and slower projectiles. In the use of dual diameter, tube-in-tube, collapsible launchers, the effective barrel length (for rocket support) is reduced to one-half the actual length. To avoid this problem, the anti tip-off device of this invention provides rocket support to the nose of the rocket during transit of the forward or larger diameter launcher tube. It is critical that the anti tip-off device and the rear rocket support are released at the same time. Support should be provided by the anti tip-off devices until the tail fin or aft end of the rocket clears the inner tube. In this case, the rocket is supported at the front and back ends for an equal period of time.

Figure 1:
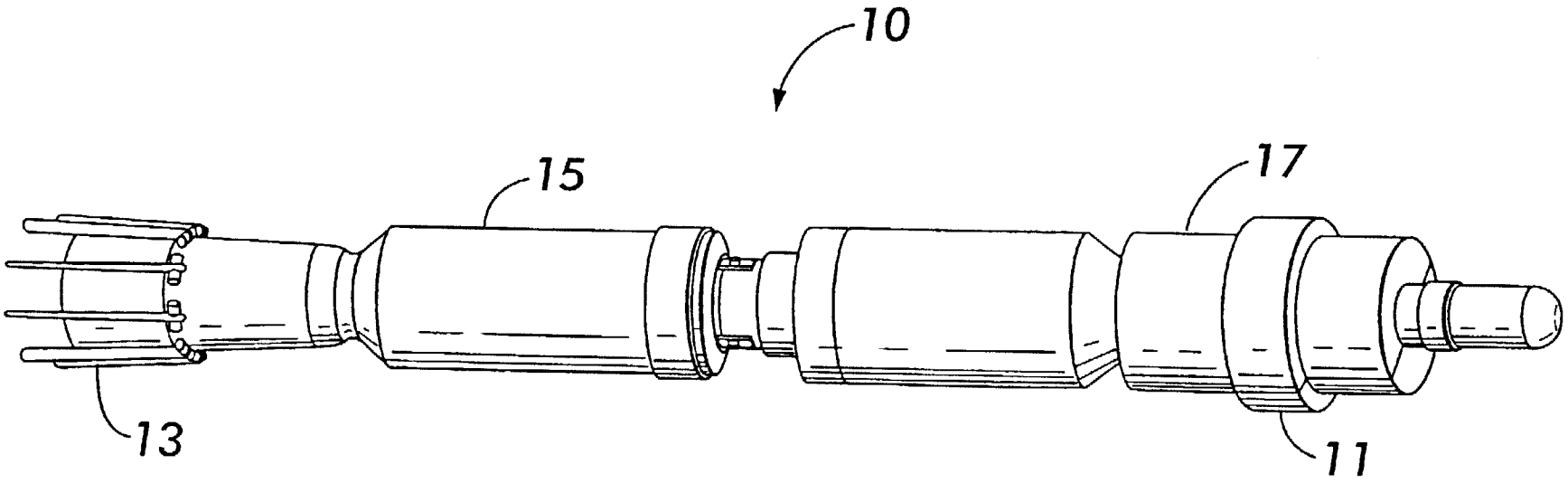
FIG. 1 is a side view of a rocket with the anti tip-off device installed.

The anti tip-off device may be released upon muzzle exit or permanently attached to the rocket as either a solid ring or a set of at least three solid stabilizing legs evenly spaced around the circumference of the rocket. As shown in FIG. 1, the anti tip-off device 10 may be constructed so that it can separate from the rocket 15 during firing. In that embodiment, anti tip-off device 10 is formed with two or more cylindrical segments 17, each having a sliding bearing surface 11 located circumferentially around the segments 17. The sliding bearing surface 11 is located longitudinally so that the distance between the sliding bearing surface 11 and the aft end of the rocket folding fins 13 is the same length as the length of the larger diameter tube on the launcher. The segments 17 are held together to form a hollow cylinder with a breakable filament around the forward and rearward ends of the cylinder.

Figure 2:
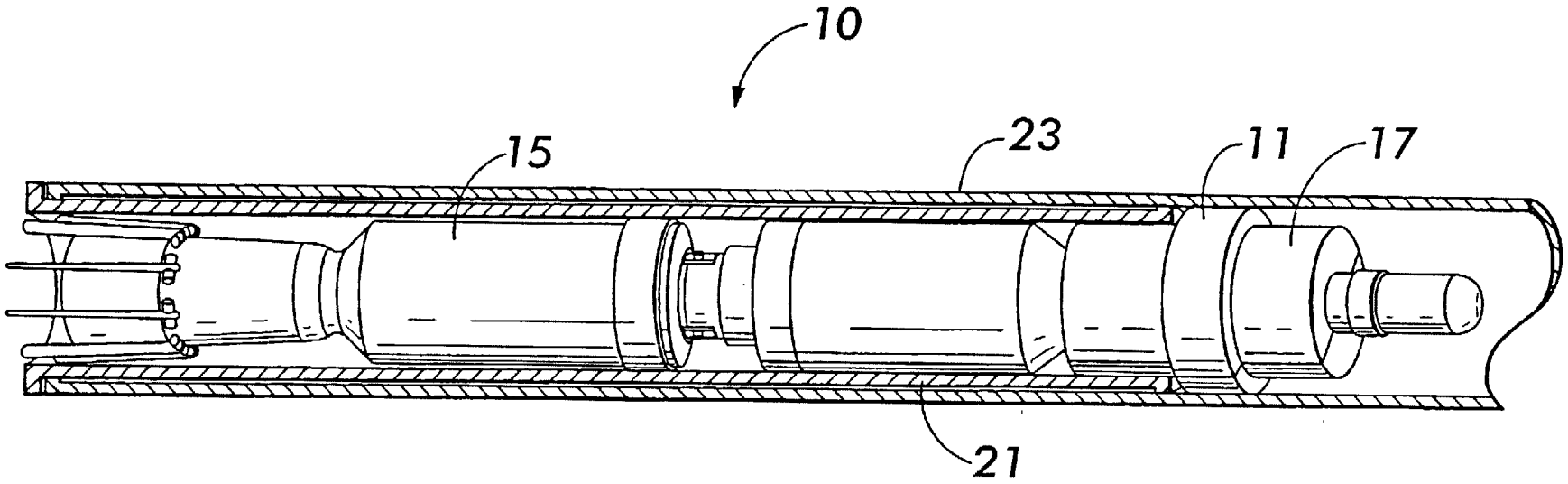
FIG. 2 is a side view showing a rocket with the attached anti tip-off device inside a collapsed dual-diameter launcher tube.

Referring now to FIG. 2, a rocket 15 is shown in a collapsed dual-diameter launcher tube having a smaller diameter tube 21 and a larger diameter tube 23. Anti tip-off device 10 is located on the forward section of the rocket 15 and, as depicted, the sliding bearing surface 11 rides on the inner surface of the larger diameter launcher tube 23.

Figure 3:
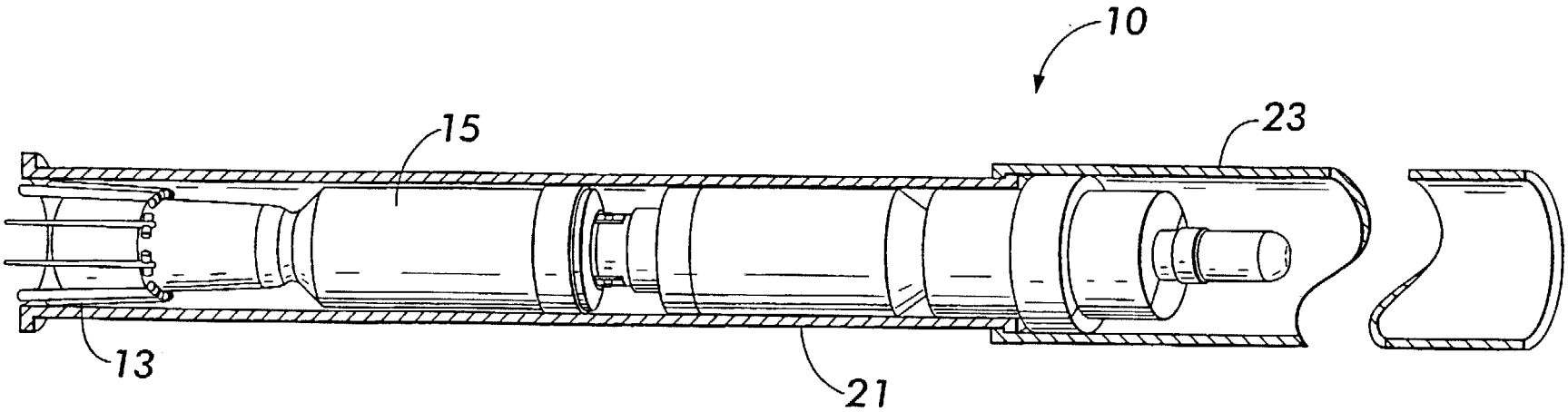
FIG. 3 is a side view showing the dual-diameter launcher tube extended with the rocket ready to fire.

As shown in FIG. 3, when the collapsible launcher tube is extended, that is, tube 23 is pulled out from tube 21, the rocket 15 is ready for firing. Sliding support for the rear part of the rocket 15 (inside the small diameter tube 21) is provided by the folding fins 13. Sliding support for the forward part of the rocket (inside the larger diameter tube 23) is provided by the cylinder form and sliding surfaces of the segments of the anti tip-off device 10.

Figure 4:
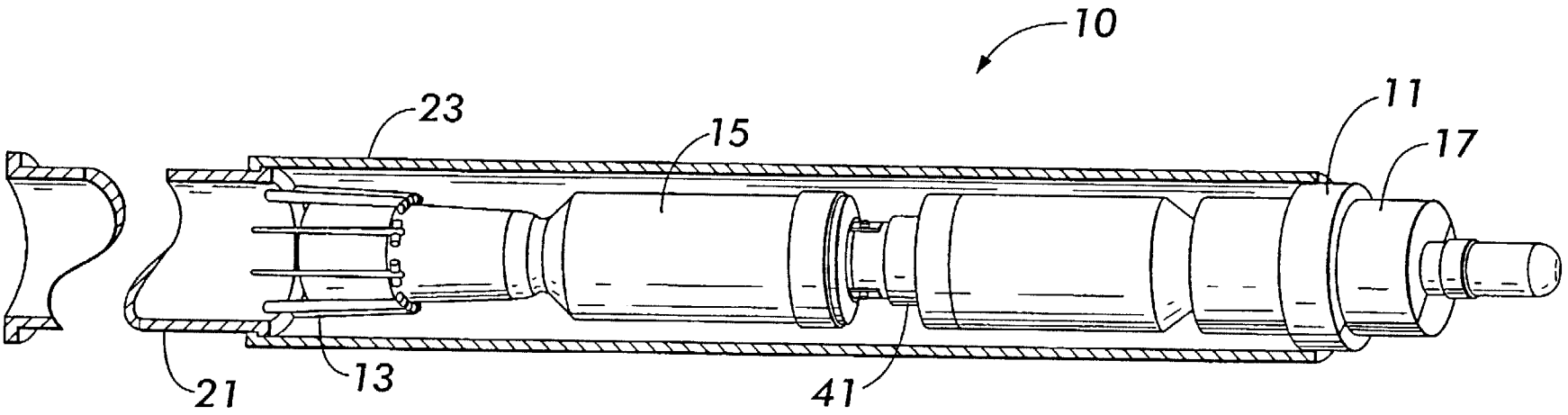
FIG. 4 is a side view showing the rocket exiting the smaller diameter launch tube.

Muzzle exit of the rocket may be seen in FIG. 4. As the forward end of the rocket 15 exits the larger diameter tube 23, the aft end of the rocket 41 exits the smaller diameter tube 21. The rocket 15 exits the muzzle of the launcher tube aligned by the anti tip-off device 10 at the forward end of the larger tube 23 and aligned by the aft bore rider shown as the folding fins 13 at the forward end of the smaller diameter tube 21. The rocket thereafter clears both tubes without further support due to its muzzle velocity.

Figure 5:
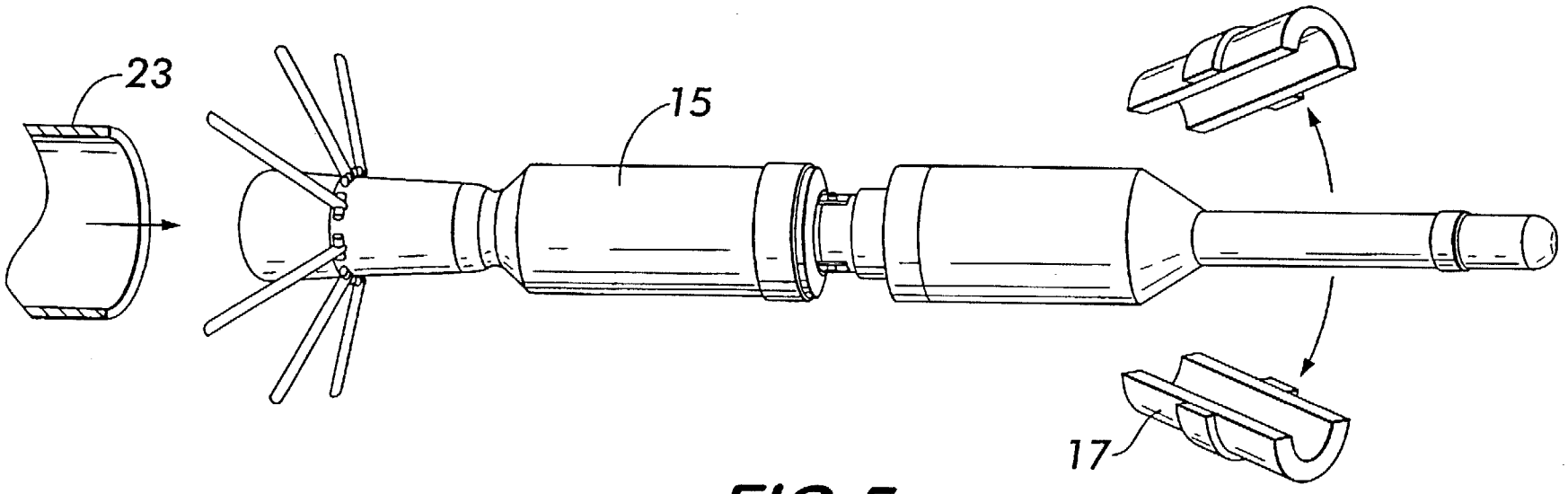
FIG. 5 is a side view showing the rocket exiting the larger diameter launch tube.

Referring to FIG. 5, immediately following muzzle exit, the segments 17 of the anti tip-off device separate and break away from the rocket 15 allowing the rocket 15 to proceed to its target. This configuration of the slide-on style cylinder of the anti tip-off device allows either factory or field addition of the device to the current standard high explosive anti-armor rounds.

Figure 6:
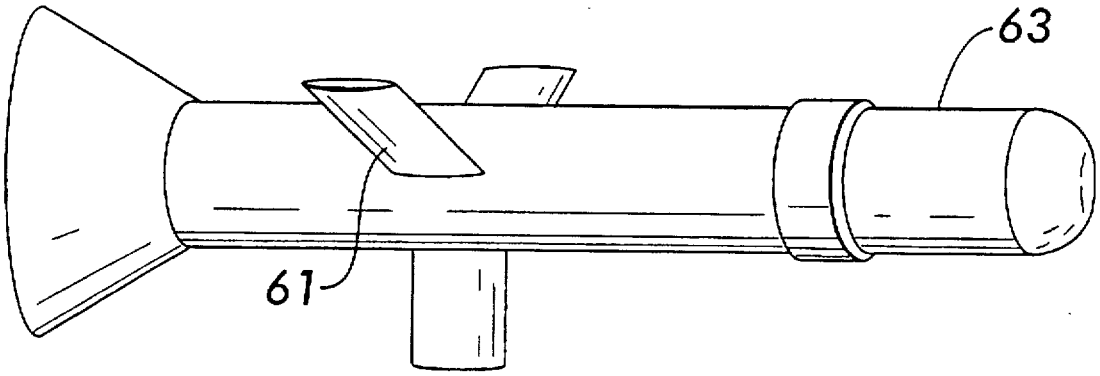
FIG. 6 is a partial perspective view of the rocket showing an alternate embodiment of the anti tip-off device comprising three stabilizer legs.

In an alternative configuration, as seen in FIG. 6, the anti tip-off device may be permanently attached to a rocket by bonding three stabilizer legs 61 to the rocket nose section 63. In this embodiment, the stabilizing legs 61 remain with the rocket 15 during flight having only a small decrement in rocket performance. As in the previous embodiment, placement of the legs 61 must be such that the forward and rear support of the rocket ends simultaneously. By using three or more stabilizer legs 61 equally spaced around the circumference of rocket, the rocket 15 can be precisely guided along the firing axis of firing tube 23. The location of the anti tip-off device along the length of the rocket is important because both fore and aft support must be provided or released simultaneously. Although the preferred embodiment of the present invention includes just three stabilizer legs, this number is the minimum required to guarantee stability in both the horizontal and vertical axes. However, additional stabilizers may be used within the scope of this invention.

Figure 7:
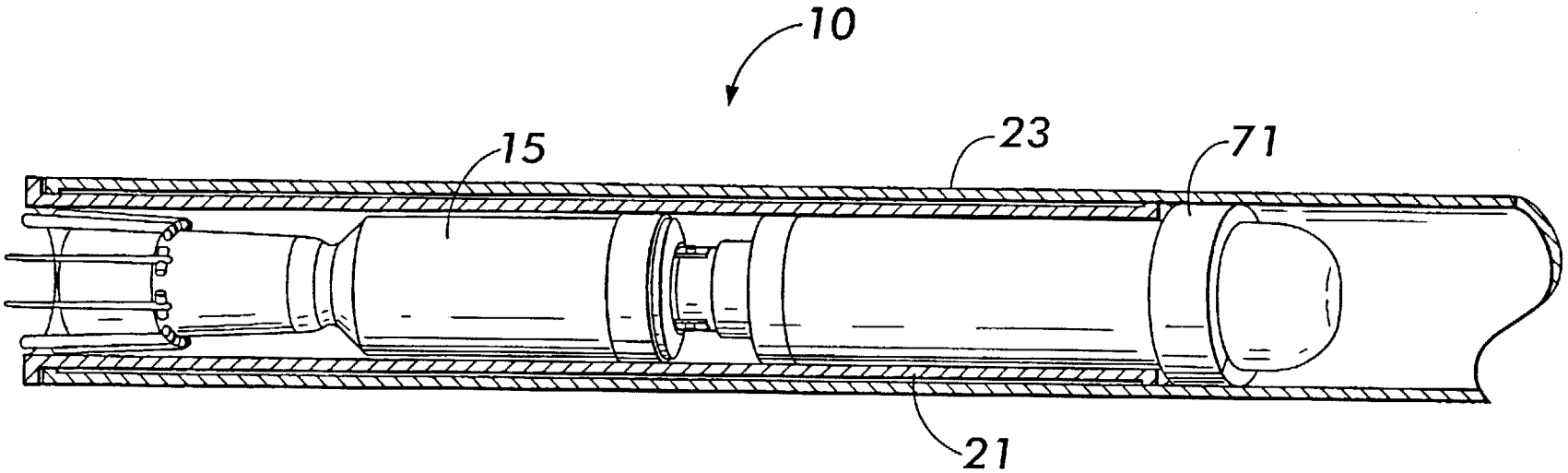
FIG. 7 is a partial perspective view of the rocket showing the ring stabilizer version of the anti tip-off device.

A further alternate embodiment of the anti tip-off device is depicted in FIG. 7. In this embodiment, a permanently attached ring 71 is located at the required location to provide a sliding surface to match the inside diameter of the larger tube. This configuration requires factory bonding of the ring, but provides for easy modification of the existing common practice rounds and the existing high explosive dual purpose rounds, each having shortened and rounded nose sections.

The design of the anti tip-off device may vary substantially within the scope of the invention as well. The length of the stabilizers should be constructed so as to provide necessary strength to prevent shearing or deformation during firing. This construction will vary depending on the type of material used; however, a wide variety of materials can be used including lexan, TEFLON™(Polytetrafluorethylene) TEFLON, nylon, wood, and aluminum.

The features and advantages of the present invention are numerous. The segment embodiment of the invention permits simple attachment of the anti tip-off device to existing high explosive anti-armor rounds allowing the same rounds to be interchanged between weapons in the field. Additionally, the alternate forms of the invention allow permanent factory addition to other types of existing rocket rounds without the need to alter the existing rounds. Finally, the invention reduces rocket wobble and improves accuracy for collapsible launchers when using existing ordnance. Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. An anti tip-off device for a rocket launched from a collapsible tube-in-tube, dual diameter launcher having larger and smaller diameter tubes comprising:

segment shells forming a cylindrical shape having a hollow interior adapted to fit over a nose section of standard high explosive anti-armor rockets; and a sliding bearing surface attached to said segment shells and located around the circumference to provide a bearing surface during rocket transit of a larger diameter tube, said sliding bearing surface located longitudinally so that the distance from the bearing surface to the aft end of the rocket is the same distance as the internal length of the larger diameter launch tube.

2. An anti tip-off device for a rocket launched from a collapsible tube-in-tube, dual diameter launcher as in claim 1 wherein said segment shells further comprise a ring adapted for attachment to a common practice round nose section.

3. An anti tip-off device for a rocket launched from a collapsible tube-in-tube, dual diameter launcher as in claim 1 wherein said sliding bearing surfaces are fabricated from a material selected from the group of lexan, polytretra flourethylene, nylon, wood and aluminum.

* * * * *